United States Patent [19]

Klett

[11] 4,039,102

[45] Aug. 2, 1977

[54] DEVELOPER DOOR WITH USE COUNTER ON DOOR

[75] Inventor: Stanley D. Klett, Fairport, N.Y.

[73] Assignee: Xerox Corporation, Stamford, Conn.

[21] Appl. No.: 670,517

[22] Filed: Mar. 24, 1976

[51] Int. Cl.[2] ..... B67D 5/22

[52] U.S. Cl. ..... 222/38; 222/153; 222/556; 222/DIG. 1

[58] Field of Search ..... 222/36, 38, 153, 556, 222/DIG. 1

[56] References Cited

U.S. PATENT DOCUMENTS

| | | | |
|---|---|---|---|
| 2,084,631 | 6/1937 | Dobyns | 222/36 X |
| 2,520,546 | 8/1950 | Hughes | 222/38 X |
| 3,091,366 | 6/1963 | Hutsell | 222/36 |
| 3,224,635 | 12/1965 | Rivera | 222/36 |
| 3,356,248 | 12/1967 | Del Vecchio | 222/DIG. 1 |
| 3,897,888 | 8/1975 | Grau | 222/38 |

*Primary Examiner*—Robert B. Reeves
*Assistant Examiner*—David A. Scherbel
*Attorney, Agent, or Firm*—Earl T. Reichert

[57] ABSTRACT

A developer for an electrostatic reproduction machine has a dump door for opening and closing a discharge opening in the bottom of the developer. The door has two parallel channels formed therein and an actuator rod formed so that a portion of the actuator rod is slidably retained within each channel. The dump door is mounted to pivot about one of the channels toward and away from the discharge opening, a short support rod pivotally supporting one end of the door, and one end of the actuator rod supporting the other end of the door. The one end of the actuator rod is formed into a loop, the tip of which can be inserted into or removed from either of two openings in the developer housing by sliding the actuator rod in the channels. By inserting this tip into one of these openings, the dump door is locked in either an open or closed position. A switch mounted adjacent the support rod is closed to cause a count to be registered on a counter each time the dump door is opened.

2 Claims, 3 Drawing Figures

DEVELOPER DOOR WITH USE COUNTER ON DOOR

BACKGROUND OF THE INVENTION

The present invention relates generally to the developer of an electrostatic reproduction machine, but more particularly to improved means for periodically emptying developing material from a discharge opening in the developer, and means for counting the number of times the discharge opening has been opened.

In conventional xerography, a xerographic plate comprising a layer of photosensitive insulating material affixed to a conductive backing is used to support electrostatic latent images. In the xerographic process, the photosensitive surface is electrostatically charged, and the charged surface is then exposed to a light pattern of the image being reproduced to thereby discharge the surface in the areas where light strikes the surface. The undischarged areas of the surface thus form an electrostatic charge pattern (an electrostatic latent image) conforming to the original pattern. The latent image is then developed by contacting it with a finely divided electrostatically attractable powder referred to as "toner". Toner is held on the image areas by the electrostatic charge on the surface. Where the charge is greater, a greater amount of toner is deposited. Thus, a toner image is produced in conformity with a light image of the copy being reproduced. Generally, the developed image is then transferred to a suitable transfer member (e.g., paper), and the image is affixed thereto to form a permanent record of the original document.

In practice of xerography, the transfer member is caused to move in synchronized contact with the photosensitive surface during the transfer operation, and an electrical potential opposite from the polarity of the toner is applied to the side of the paper remote from the photosensitive surface to electrostatically attract the toner image from the surface to the paper.

In a prior art developer it was necessary to entirely remove the dump door in order to empty the developing material. Because the door was on the bottom of the developer and near the very bottom of the machine, a key operator had to get down on his or her hands and knees to remove the door. A clamp was removed from the end of the door nearest the key operator, and the door was pulled toward the operator so as to pull two tabs on the other end of the door out of corresponding openings in the developer wall, thus causing the door and the developing material to drop into a receptacle placed beneath the developer. There were at least three problems with this arrangement. First, the key operator had to brush toner off the door before replacing it which meant the operator's hands and clothing often got quite dirty. The second problem was that the door was difficult to replace since the operator had to align the two tabs with the corresponding openings in the developer wall in the rear of the reproduction machine. The third problem was related to the second and that was the possibility that the operator might get his or her fingers caught in a paddle wheel located within the developing apparatus just above the dump door when attempting to replace the door.

Another problem with prior art developers was that there was no way of correlating the copy count with the number of times the dump door had been opened to empty the developing material. Since the manufacturer of the developing material often warrants that the material will last for a certain number of copies, it is desirable that he be able to determine this correlation.

Thus, what is needed is an improved means for emptying developing material from a discharge opening in the developer and means for indicating the number of times that the discharge opening has been opened. The emptying means should also have a minimum number of parts and be easy to mount over the existing discharge opening of the developer housing.

SUMMARY OF THE INVENTION

The present invention is directed to an improved developer for an electrostatic reproduction machine, the developer having an improved dump door arrangement for emptying developing material from the developer and means for indicating the number of times the dump door is opened. The developer includes a housing which has a bottom with a discharge opening formed therethrough, and two sides which extend below the bottom. A dump door having two parallel channels which face each other extends over the discharge opening so that the channels are substantially perpendicular to the sides, the dump door being mounted to pivot around one of the channels toward and away from the discharge opening to close and open the same. To pivotally support the dump door, an actuator rod extends from one of the channels, beyond one end of the dump door, and through a first opening in one of the two sides, while a short support rod affixed in the same channel extends beyond the other end of the dump door and through an opening in the other side. The actuator rod is formed so that a first portion thereof is slidably retained in one of the channels, and a second portion thereof is slidably retained in the other channel. In addition to the first opening, the one side also includes second and third openings located to lock the dump door in either an open or closed position. The one end of the actuator rod is formed into a loop so that the tip thereof faces the other side of the developer housing. By grasping this loop and either pushing or pulling on the actuator rod so as to cause the latter to slide within the channels, the tip of the loop can either be moved into or out of either of the second and third openings; thus, this either locks the door in a desired position, or unlocks the door so that it can be moved to another position. To count the number of times the dump door is opened, a switch is mounted on the developer housing adjacent to a bent portion of the support rod. Each time the dump door is opened, the support rod contacts and thus closes the switch which causes a counter to register a count.

DESCRIPTION OF THE INVENTION

Figure 1:
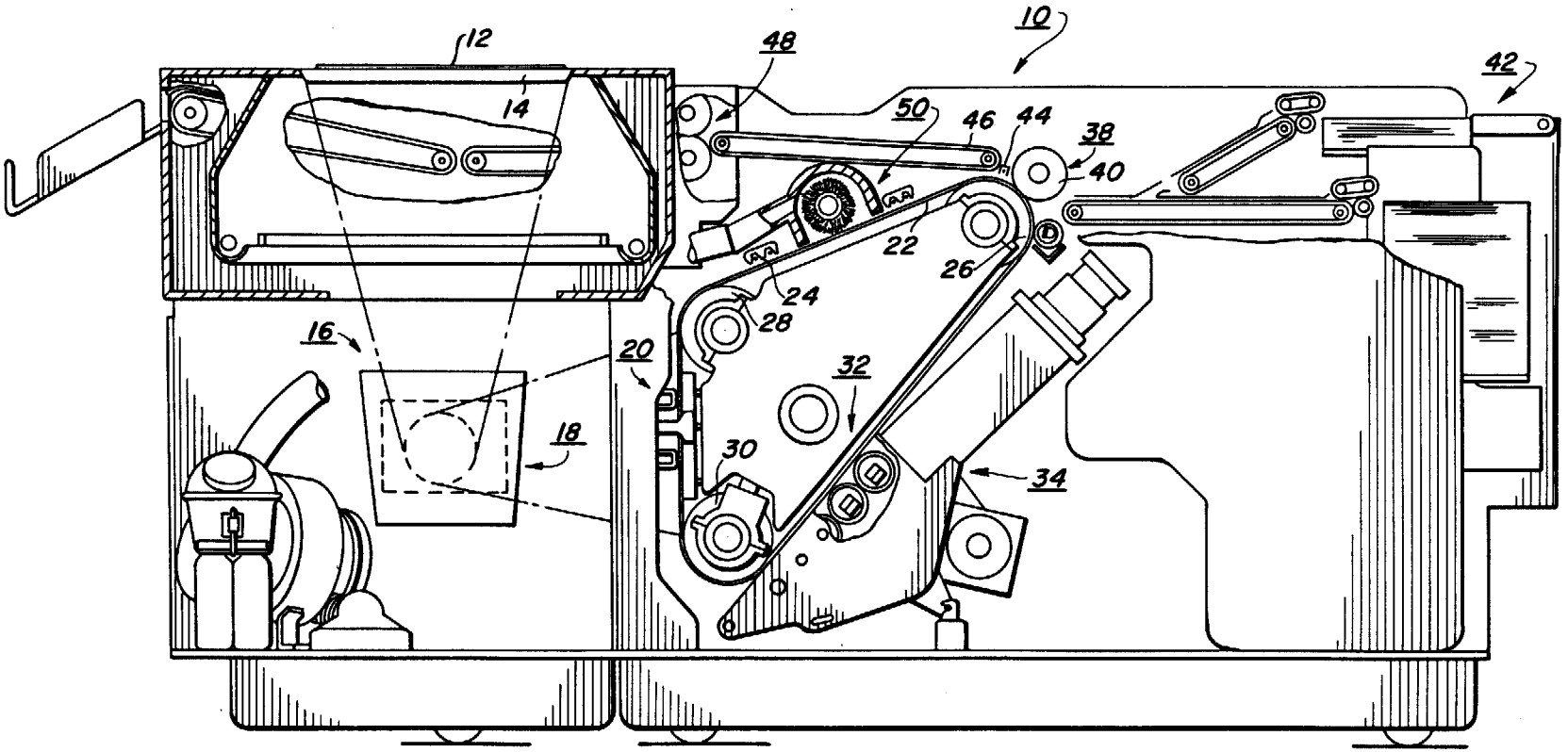
FIG. 1 is a schematic sectional view of an electrostatic reproduction machine embodying the principles of the present invention.

For a general understanding of an electrostatic reproduction machine in which the present invention may be incorporated, reference is made to FIG. 1. As in all electrostatic reproduction machines of the type illustrated, a light image of an original is projected onto the photosensitive surface of a xerographic plate to form an electrostatic latent image thereon. Thereafter, the latent image is developed with an oppositely charged developing material comprising carrier beads and toner particles triboelectrically adhering thereto to form a xerographic powder image corresponding to the latent image on the photosensitive surface. The powder image is then electrostatically transferred to a transfer member such as a sheet of paper to which it may be fixed by a fusing device whereby the toner image is caused permanently to adhere to the transfer member.

In the illustrated machine 10, an original 12 to be copied is placed upon a transparent support platen 14 fixedly arranged in an illumination assembly indicated generally by the reference numeral 16. While upon the platen, the illumination assembly flashes light rays upon the original, thereby producing image rays corresponding to the informational areas on the original. The image rays are projected by means of an optical system 18 to an exposure station 20 for exposing the surface of a moving xerographic plate in the form of a flexible photoconductive belt or photoreceptor 22. In moving in the direction indicated by the arrow, prior to reaching the exposure station 20, that portion of the belt being exposed would have been uniformly charged to approximately +900 volts by a corona generating device 24 located at a belt run extending between the belt supporting rollers 26 and 28. The exposure station extends between the roller 28 and a third roller 30.

The exposure of the photosensitive surface of the belt to the light image discharges the surface in the areas struck by light whereby an electrostatic latent image remains on the belt in image configuration corresponding to the light image projected from the original on the support platen. As the belt continues its movement, the latent image passes around the roller 30 and through a developing station 32 where a developer indicated generally by the reference numeral 34 is positioned. The developer 34 comprises a plurality of magnetic brushes 36 which carry developing material to the surface of the upwardly moving belt 22. As the developing material is applied to the belt, toner particles in the development material are electrostatically attracted to the charged photosensitive surface to form a powder image (a developed image).

The developed image is transported by the belt 22 to a transfer station 38 where a sheet of paper is moved at a speed in synchronism with the moving belt in order to effect transfer of the developed image. Located at the transfer station 38 is a transfer roll 40 which is arranged on the frame of the machine to contact the back side of the sheet of paper as the latter is moved or fed between the belt and the transfer roll. The roll 40 is electrically biased with sufficient voltage so that the developed image on the belt may be electrostatically attracted to the adjacent side of a sheet of paper as the latter is brought into contact therewith.

A suitable sheet transport mechanism transports sheets of paper seriatim from a paper handling mechanism indicated generally by the reference numeral 42 to the developed image on the belt as the same is carried around the roller 26.

As a sheet emerges from the transfer station 38, a charge is deposited thereon by a a detack corona generating device 44 to lessen the electrostatic attraction between the belt 22 and the sheet so that the latter can be removed by a vacuum stripping and transport mechanism 46. The sheet is thereafter retained on the underside of the vacuum stripping transport mechanism 46 for movement into a fuser assembly indicated generally by the reference numeral 48 wherein the powder image on the sheet is permanently affixed thereto. After fusing, the finished copy is discharged at a suitable point for collection. The toner particles remaining as residue on the belt 22 are carried by the belt to a cleaning apparatus 50 where they are removed.

Figure 2:
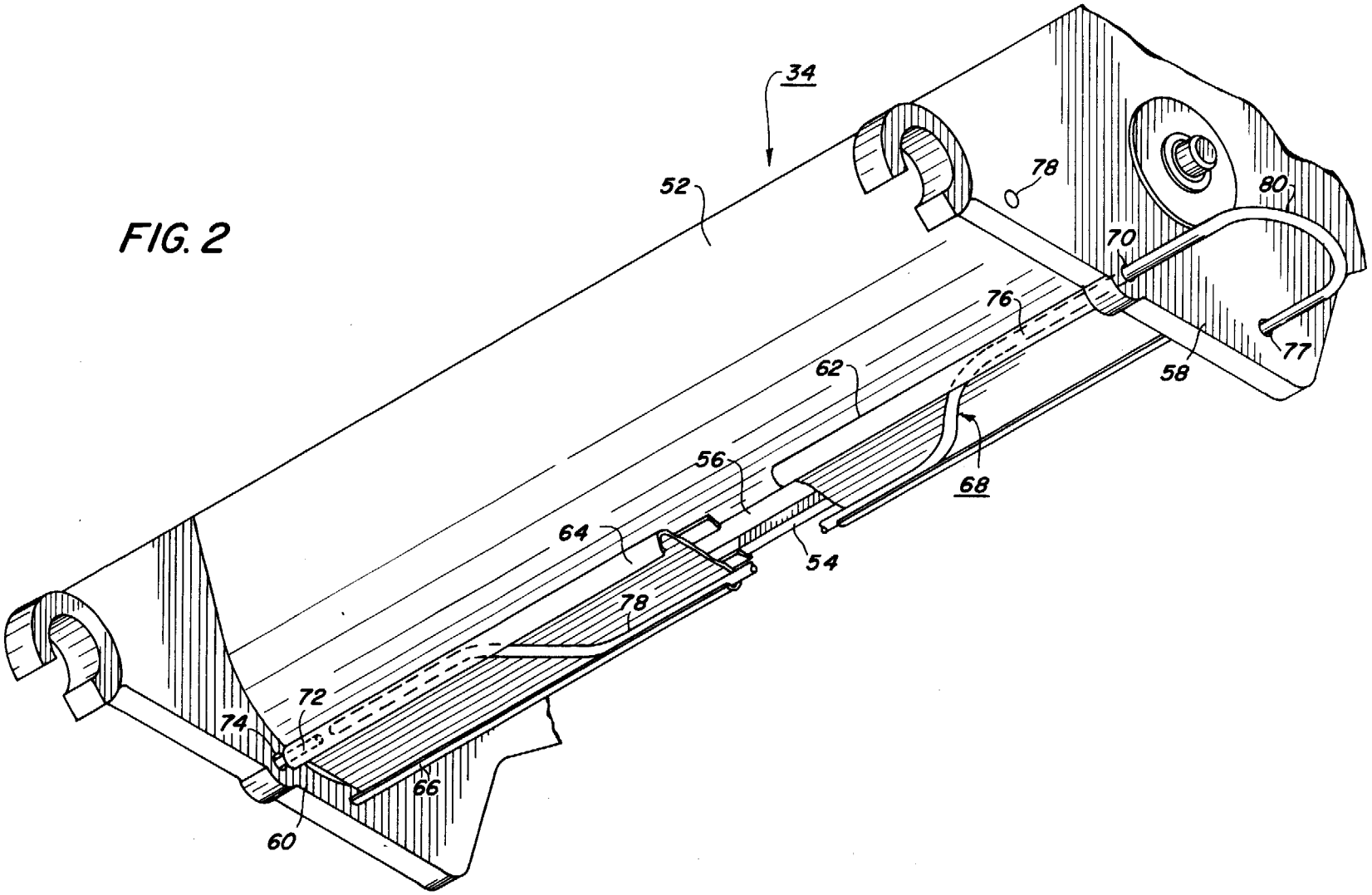
FIG. 2 is a perspective view of the bottom of the developer housing showing the dump door in a closed position.
Figure 3:
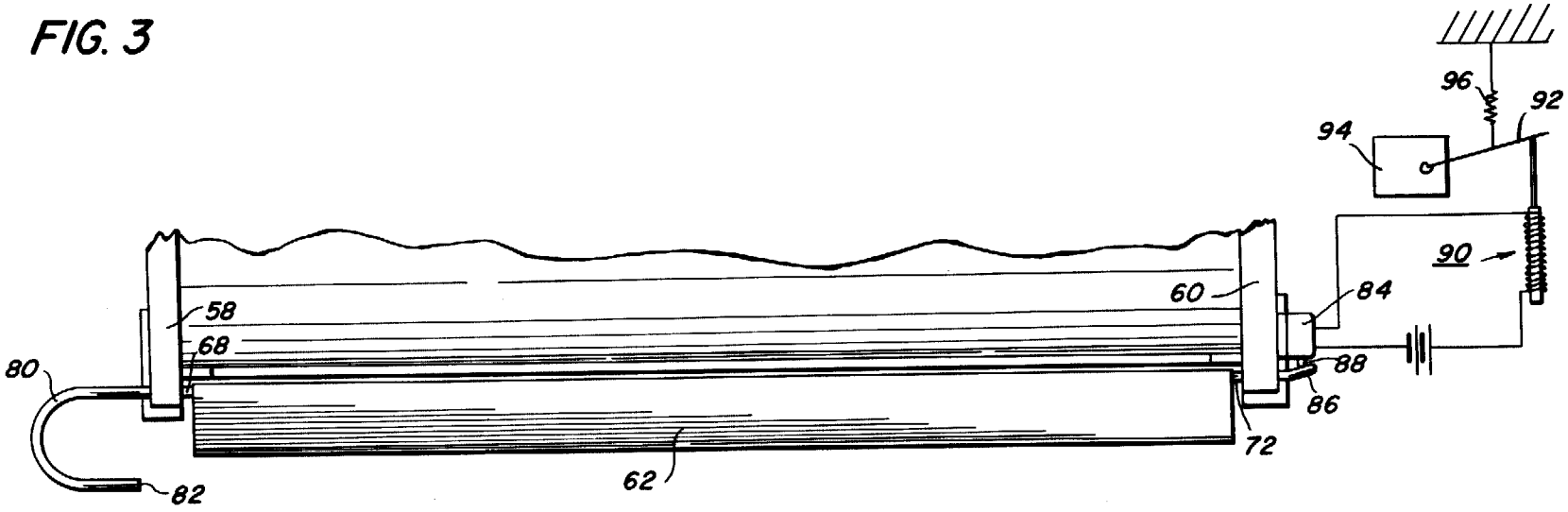
FIG. 3 is an end view of a portion of the developer showing the dump door hanging in an open position.

Referring to FIGS. 2 and 3, the present invention will now be described in detail. The developer 34 includes a housing 52 which has a bottom 54 with a discharge opening 56 formed therethrough, and two parallel sides 58 and 60 which extend below the bottom of the housing. A dump door 62 having two parallel channels 64 and 66 which face each other extends over the discharge opening 56 in the closed position so that the channels are substantially perpendicular to the sides 58 and 60, the dump door being pivotally mounted to pivot around channel 64 toward and away from the discharge opening to close and open the same. To pivotally support the dump door, an actuator rod 68 extends from the channel 64. beyond one end of the dump door 62, and through a first opening 70 in the side 58, while a short support rod 72 affixed in the same channel extends beyond the other end of the dump door and through an opening 74 in the side 60. If there is sufficient room in the reproduction machine, the support rod 72 can be eliminated, and the actuator rod made long enough to extend through the opening 74 a substantial distance so that the actuator rod will not be pulled from the opening when unlocking the door. The actuator rod 68 is formed so that a first portion 76 is slidably retained in the channel 64, and a second portion 78 is slidably retained in channel 66. In addition to the opening 70, side 58 also includes openings 77 and 78 located to lock the dump door in either a closed or open position respectively. The one end of the actuator rod 68 is formed into a loop 80 so that the tip 82 thereof (see FIG. 3) faces side 60 of the developer housing 52. By grasping the loop 80 and either pushing or pulling on the actuator rod 68 so as to cause the latter to slide within the channels 64 and 66, the tip 82 is either moved into or out of one of the openings 77 or 78; thus this either locks the dump door 62 in a desired position, or unlocks the dump door so that it can be moved to another position. To count the number of times the dump door 62 is opened, a switch 84 is mounted on the developer housing adjacent to a bent portion 86 of the support rod. Each time the dump door 62 is opened, the bent portion 86 of support rod contacts the probe 88 of the switch to the latter. When the switch closes, a solenoid 90 is actuated to move a lever arm 92 of a counter 94 against the bias of a spring 96 and register one count on the counter. Counter 94 may be any suitable counter which gives a visual indication of the counts recorded, e.g., a Veeder-Root counter. When the door is closed, the switch 84 opens to deactivate the solenoid 90.

While the invention has been described with reference to the structure disclosed, it is not confined to the details set forth, but is intended to cover such modifications or changes as may come within the scope of the following claims.

What is claimed is:

1. An improved developer for developing an electrostatic latent image on a photoreceptor, the developer having a housing for containing developing material, the housing having a bottom and a first side and an opposite second side both of which sides extend below the bottom, means for applying the developing material to the photoreceptor, and a discharge opening formed in the bottom of the housing for emptying the developing material when it is desired to change the latter, wherein the improvement comprises:

a. a dump door having means forming first and second channels thereon, the channels being parallel to and facing each other and generally perpendicular to the first and second sides of the developer housing, b. means for pivotally supporting the door for movement toward and away from the discharge opening to close and open the latter, the pivotally supporting means including:

a unitary actuator rod having a first portion slidably retained in the first channel and a second portion slidably retained in the second channel, and a first opening formed in the first side of the developer housing through which one end of the actuator rod extends to pivotally support one end of the dump door, and c. means including a loop on the one end of the actuator rod, and a second opening formed in the first side of the developer housing into which the tip of the loop extends for retaining the dump door in a closed position, whereby the loop can be pulled to cause the rod to slide within the channels to remove the tip from the second opening and thus allow the door to be moved away from the discharge opening.

2. An improved developer as set forth in claim 1, which further includes means for counting the number of times the dump door is opened.

* * * * *